US011187473B1

(12) United States Patent
Richey

(10) Patent No.: US 11,187,473 B1
(45) Date of Patent: Nov. 30, 2021

(54) FIREARM

(71) Applicant: A. W. Richey, Cleveland, SC (US)

(72) Inventor: A. W. Richey, Cleveland, SC (US)

( * ) Notice: Subject to any disclaimer, the term of this patent is extended or adjusted under 35 U.S.C. 154(b) by 0 days.

(21) Appl. No.: 17/164,113

(22) Filed: Feb. 1, 2021

(51) Int. Cl.
*F41A 3/66* (2006.01)
*F41A 3/38* (2006.01)
*F41A 19/13* (2006.01)

(52) U.S. Cl.
CPC ..... *F41A 3/38* (2013.01); *F41A 19/13* (2013.01)

(58) Field of Classification Search
CPC ..... F41A 3/26; F41A 3/22; F41A 3/66; F41A 21/28; F41A 21/482; F41A 17/38; F41A 5/20
USPC ..... 42/7, 25, 75.02, 76.01, 16
See application file for complete search history.

(56) References Cited

U.S. PATENT DOCUMENTS

| | | | | |
|---|---|---|---|---|
| 544,659 | A | 8/1895 | Browning | |
| 984,519 | A | 2/1911 | Browning | |
| 3,314,183 | A * | 4/1967 | Center | F41A 19/44 42/69.03 |
| 3,675,534 | A * | 7/1972 | Beretta | F41G 1/16 89/185 |
| 3,874,265 | A * | 4/1975 | Kruzell | F41A 3/38 89/1.801 |
| 4,061,075 | A | 12/1977 | Smith | |
| 4,095,507 | A | 6/1978 | Close | |
| 4,253,378 | A * | 3/1981 | Donovan | F41A 3/42 89/142 |
| 4,270,437 | A * | 6/1981 | Donovan | F41A 3/38 89/192 |
| 5,651,205 | A * | 7/1997 | Ruger | F41A 17/24 42/70.08 |
| 5,758,445 | A | 6/1998 | Casull | |
| 6,892,718 | B2 * | 5/2005 | Tiberius | F41B 11/51 124/74 |
| 7,770,317 | B1 * | 8/2010 | Tankersley | F41C 23/16 42/71.01 |
| 7,971,379 | B2 | 7/2011 | Robinson et al. | |
| 9,528,782 | B2 | 12/2016 | Meier | |
| 9,638,481 | B1 * | 5/2017 | Marano | F41A 3/72 |
| 10,132,579 | B2 | 11/2018 | Schenker et al. | |
| 10,466,005 | B2 | 11/2019 | Foster et al. | |
| 10,670,354 | B2 | 6/2020 | Schenker et al. | |
| 10,830,546 | B2 | 11/2020 | Fleiner et al. | |
| 2012/0180354 | A1 * | 7/2012 | Sullivan | F41A 21/48 42/16 |
| 2014/0196267 | A1 * | 7/2014 | Tiberius | F41A 33/02 29/401.1 |
| 2016/0033219 | A1 * | 2/2016 | Meier | F41C 23/16 89/191.01 |
| 2020/0116449 | A1 * | 4/2020 | Mykhailovych | F41A 7/02 |
| 2020/0256636 | A1 * | 8/2020 | Martini | F41A 3/66 |

* cited by examiner

*Primary Examiner* — Michael D David
(74) *Attorney, Agent, or Firm* — Steve LeBlanc, LLC

(57) ABSTRACT

A firearm includes a barrel having a breech end and a vent path through the barrel downstream from the breech end. A receiver is engaged with the breach end of the barrel and defines a chamber. A latch is connected to the receiver, and an actuator is downstream from the vent path and operably engaged with the latch. A bolt is at least partially inside the chamber. The bolt has a locked position in which the latch is engaged with the bolt to prevent the bolt from moving away from the breech end of that barrel and a released position in which the latch is not engaged with the bolt.

17 Claims, 12 Drawing Sheets

FIREARM

FIELD OF THE INVENTION

The present invention generally involves a firearm. Particular embodiments of the present invention may be incorporated into a semi-automatic or automatic handgun, shotgun, or rifle.

BACKGROUND OF THE INVENTION

Many designs exist for firearms such as handguns, shotguns, and rifles, and each firearm design generally includes a barrel, a receiver, and a trigger. The barrel provides a cylindrical path for a projectile to travel from a breech end, through the barrel, and out a muzzle end. The receiver connects to the breech end of the barrel and provides a chamber for holding a cartridge before and after firing. A magazine containing multiple cartridges may connect to the receiver, and a bolt or slide may be slidingly engaged with the receiver to strip the top-most cartridge from the magazine for insertion into the breech end of the barrel. Operation of the trigger releases a firing pin to strike the cartridge and ignite a propellant. Ignition of the propellant generates combustion gases that propel the projectile through the barrel and out the muzzle end.

The particular design for each firearm balances multiple and often competing design goals. For example, the receiver in a revolver handgun is typically a cylindrical component with separate, radially located chambers so that a single cartridge may be manually loaded into each chamber. The trigger is usually dual action so that depressing the trigger simultaneously cocks the firing pin while rotating the cylindrical receiver to align the next chamber with the barrel and the firing pin. The dual-action trigger then releases the firing pin to strike the cartridge and ignite the propellant. The cartridge expands to seal the chamber, causing all of the combustion gases to propel the projectile through the barrel and out the muzzle end. In contrast, the receiver in a semi-automatic handgun is typically a rectangular component that includes a slide that may be manually reciprocated to cock the firing pin while also stripping the top-most cartridge from the magazine and repositioning the cartridge into the breech end of the barrel. The trigger is usually single-action so that depressing the trigger releases the firing pin to strike the cartridge and ignite the propellant. A majority of the combustion gases propel the projectile through the barrel and out the muzzle end. A portion of the combustion gases simultaneously moves the spent cartridge rearward to reciprocate the slide, ejecting the spent cartridge, cocking the firing pin, and repositioning the next top-most cartridge from the magazine into the breech end of the barrel.

The design of the revolver handgun generally requires more force and travel to operate the dual-action trigger compared to the single-action trigger in an automatic handgun. However, the revolver handgun provides enhanced reliability in the firing sequence and also transfers the entire force produced by the propellant to the projectile. Conversely, the design of the automatic handgun requires less force and travel to operate the single-action trigger compared to the dual-action trigger in a revolver handgun, and the automatic ejecting, cocking, and reloading provided by the automatic handgun enhances the speed of multiple firings. However, the automatic cycling of the slide to eject the spent cartridge, cock the firing pin, and reload the next cartridge diverts some of the combustion gases from propelling the projectile through the barrel, reducing the amount of force produced by the combustion gases that is transferred to the projectile.

Similar design trade-offs exit between an A-bolt rifle and a semi-automatic rifle. Both rifle designs include a bolt that may be manually reciprocated in the receiver to cock the firing pin while also stripping the top-most cartridge from the magazine and relocating the cartridge into the breech end of the barrel. However, the bolt in the A-bolt rifle design locks the cartridge in the breech end of the barrel, while the bolt in the semi-automatic rifle is merely biased against the cartridge in the breech end of the barrel. As a result, the bolt in the A-bolt rifle does not allow the spent cartridge to move rearward, and all of the combustion gases propel the projectile through the barrel and out the muzzle end. However, the A-bolt rifle design requires manual cycling of the bolt before the next firing sequence. Conversely, the bolt in the semi-automatic rifle allows a portion of the combustion gases to simultaneously move the spent cartridge rearward to reciprocate the bolt, eject the spent cartridge, cock the firing pin, and reposition the next top-most cartridge from the magazine into the breech end of the barrel to enhance the speed of multiple firings. However, the automatic cycling of the bolt to eject the spent cartridge, cock the firing pin, and reload the next cartridge diverts some of the combustion gases from propelling the projectile through the barrel, reducing the amount of force produced by the combustion gases that is transferred to the projectile.

While each firearm design balances multiple and often competing design goals, the need exists for a firearm design that allows automatic cycling of the firing sequence without reducing the amount of force transferred to the projectile from the combustion gases.

BRIEF DESCRIPTION OF THE INVENTION

Aspects and advantages of the invention are set forth below in the following description, or may be obvious from the description, or may be learned through practice of the invention.

One embodiment of the present invention is a firearm that includes a barrel having a breech end and a vent path through the barrel downstream from the breech end. A receiver is engaged with the breach end of the barrel and defines a chamber. A latch is connected to the receiver, and an actuator is downstream from the vent path and operably engaged with the latch. A bolt is at least partially inside the chamber. The bolt has a locked position in which the latch is engaged with the bolt to prevent the bolt from moving away from the breech end of that barrel and a released position in which the latch is not engaged with the bolt.

An alternate embodiment of the present invention is a firearm that includes a barrel having a breech end. A receiver is engaged with the breach end of the barrel and defines a chamber. A bolt is at least partially inside the chamber. A latch is connected to the receiver. The latch has a locked position in which the latch is engaged with the bolt to prevent the bolt from moving away from the breech end of the barrel and a released position in which the latch is not engaged with the bolt. A vent path through the barrel is downstream from the breech end, and an actuator is downstream from the vent path and operably engaged with the latch. The actuator is configured to reposition the latch from the locked position to the released position.

In yet another embodiment of the present invention, a firearm includes a barrel having a muzzle end and a breech end upstream from the muzzle end. A receiver is engaged with the breach end of the barrel. A latch is pivotally connected to the receiver, and a bolt is slidingly engaged with the receiver. A vent path through the barrel is upstream from the muzzle end and downstream from the breech end. An actuator is downstream from the vent path and operably engaged with the latch. The latch has a locked position in which the latch is engaged with the bolt to prevent the bolt from moving away from the breech end of the barrel and a released position in which the latch is not engaged with the bolt.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
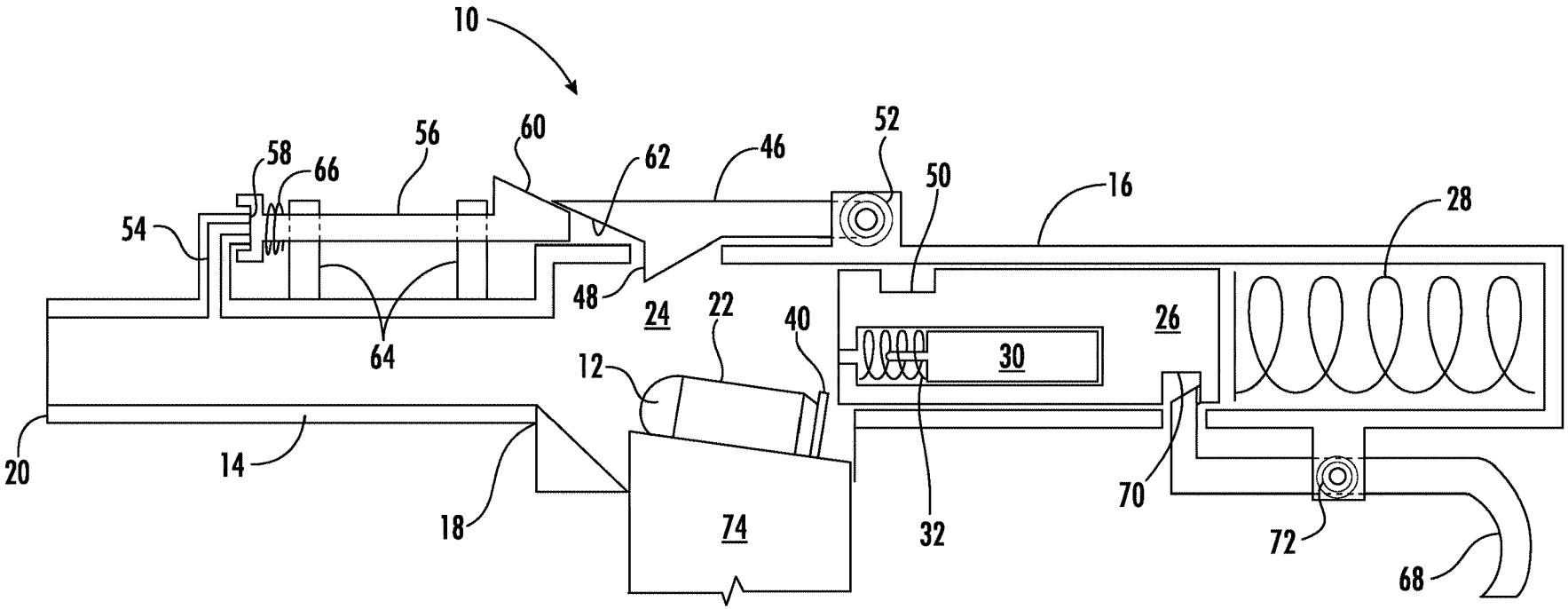
FIG. 1 is a side cross-section view of a firearm according to one embodiment of the present invention in a cocked position.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

As used herein, the terms "upstream" and "downstream" refer to the location of items with reference to the direction of fluid flow in a fluid pathway. For example, item A is "upstream" from item B and item B is downstream from item A if fluid normally flows from item A to item B. As used herein, "axial" refers to the direction of the longer axis of a component, "radial" refers to the direction perpendicular to the axial direction, and "circumferential" refers to the direction around a component.

Figure 2:
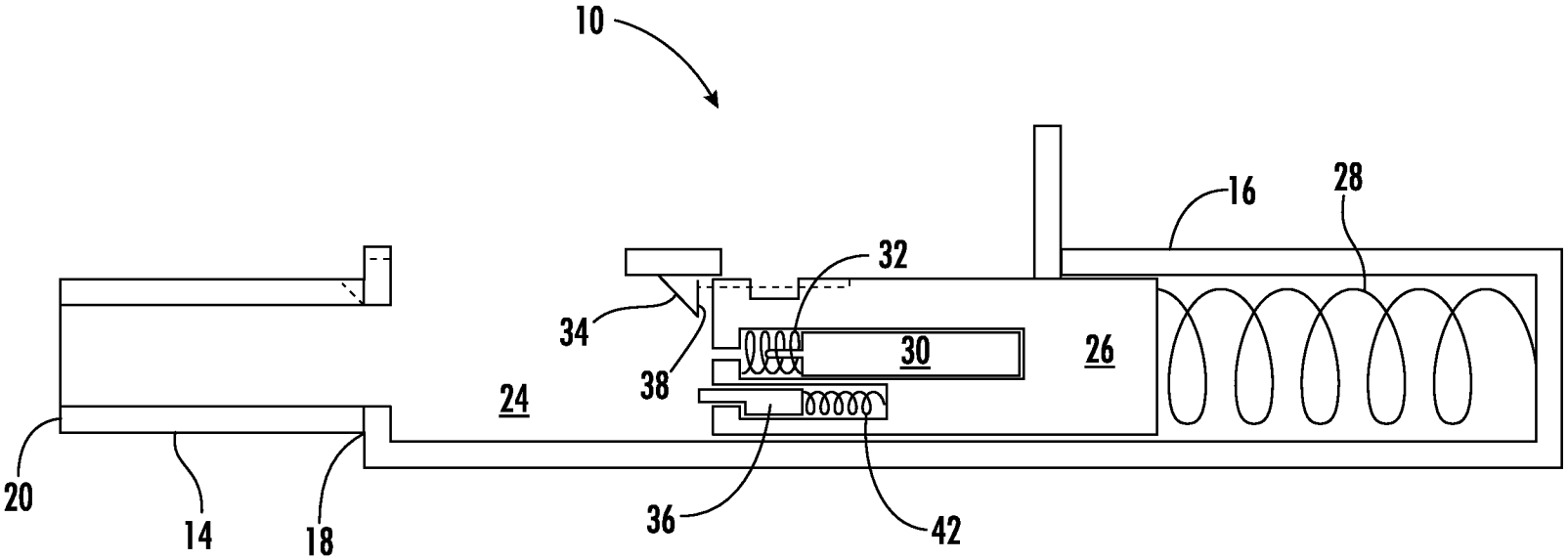
FIG. 2 is a top cross-section view of the firearm shown in FIG. 1 in the cocked position.
Figure 3:
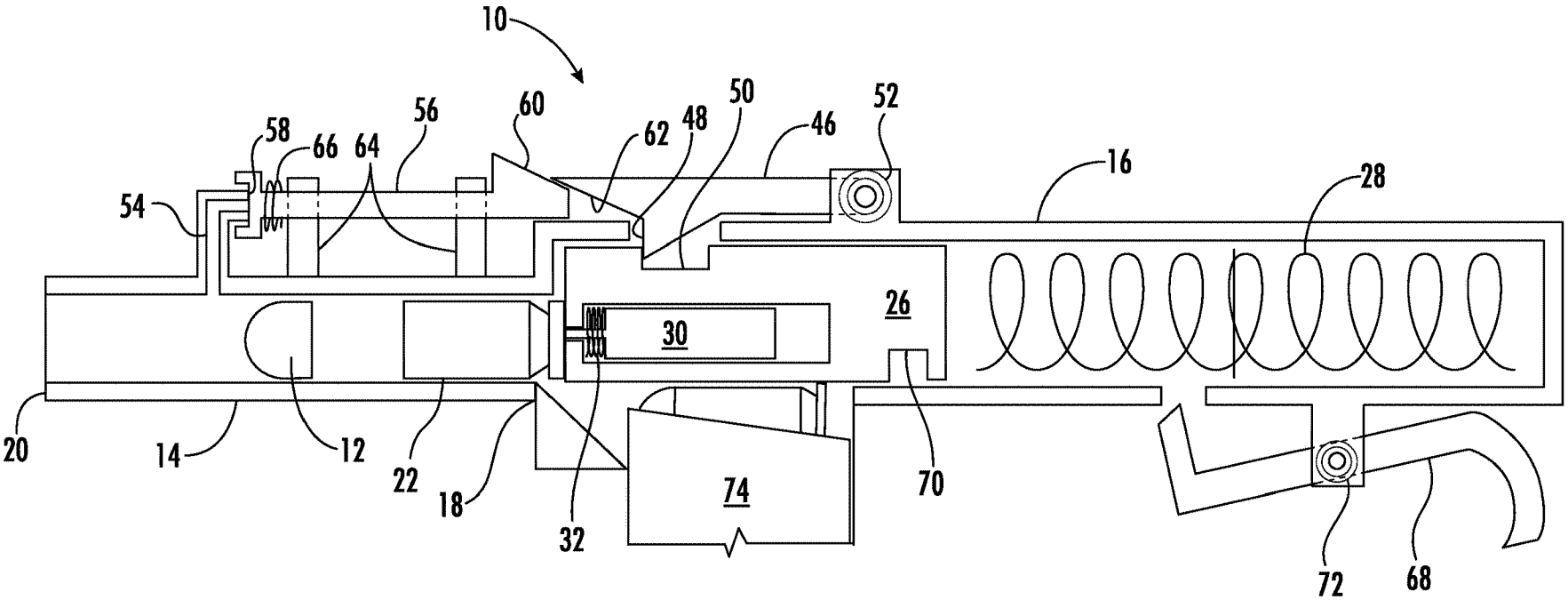
FIG. 3 is a side cross-section view of the firearm shown in FIG. 1 after firing.
Figure 4:
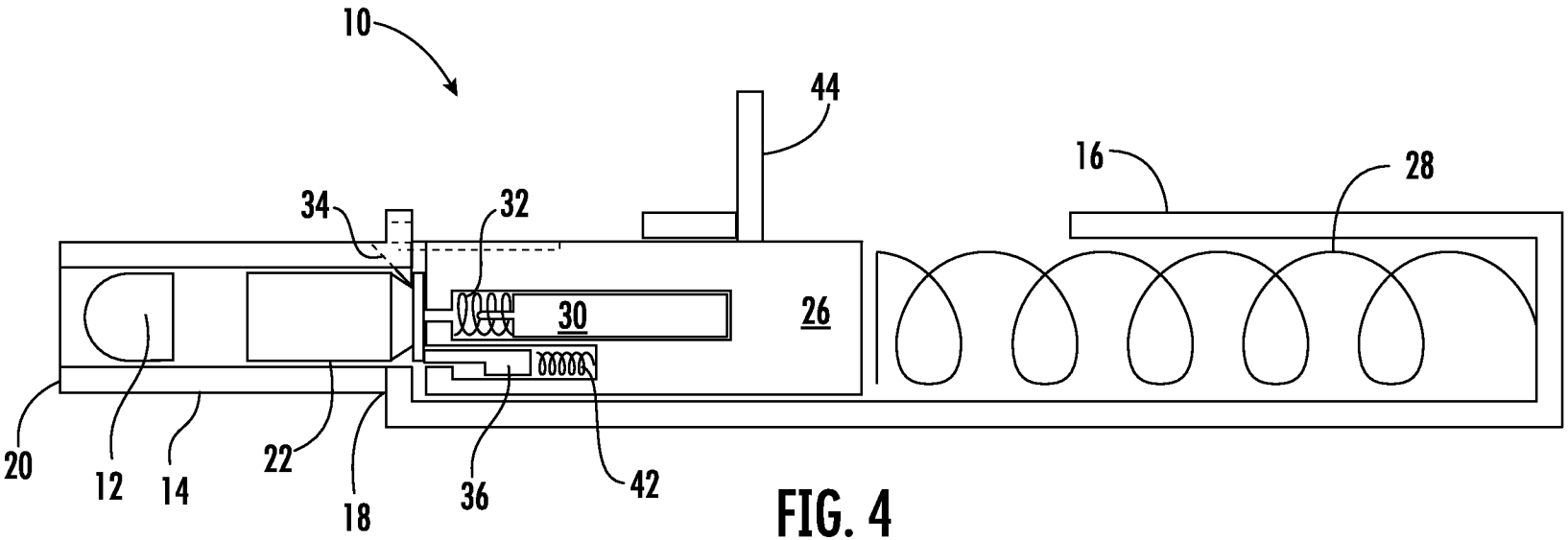
FIG. 4 is a top cross-section of the firearm shown in FIG. 1 after firing.
Figure 5:
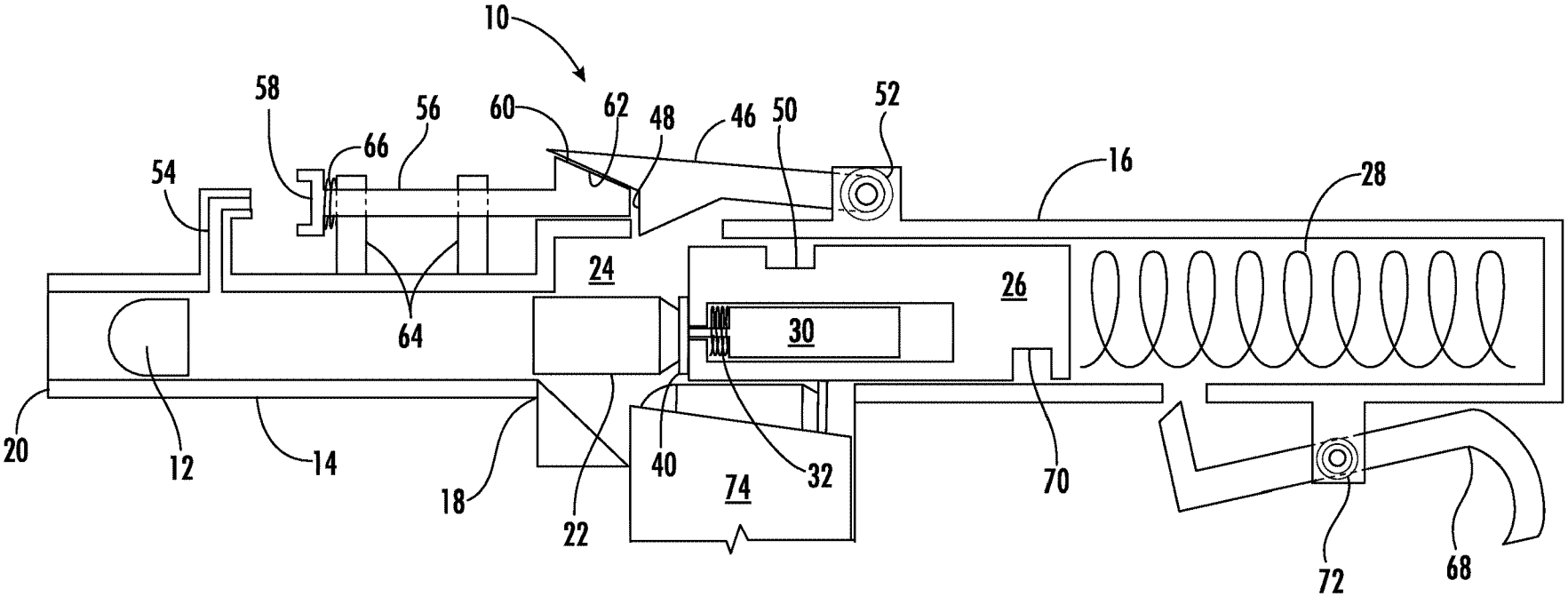
FIG. 5 is a side cross-section view of the firearm shown in FIG. 1 recoiling.

Embodiments of the present invention include a firearm 10 that allows automatic cycling of the firing sequence without reducing the amount of force transferred to a projectile 12 from combustion gases generated during the firing sequence. FIG. 1 provides a side cross-section view of the firearm 10 according to one embodiment of the present invention in a cocked position, and FIG. 2 provides a top cross-section view of the firearm 10 shown in FIG. 1. FIG. 3 provides a side cross-section view of the firearm shown in FIG. 1 after firing, and FIG. 4 provides a top cross-section of the firearm shown in FIG. 1 after firing. FIG. 5 provides a side cross-section view of the firearm shown in FIG. 1 recoiling, and FIG. 6 provides a top cross-section of the firearm shown in FIG. 1 recoiling.

As shown in FIGS. 1-6, the firearm 10 includes a barrel 14 and a receiver 16, as is generally known in the art. The barrel 14 and the receiver 16 may be forged or cast from steel or other sufficiently strong metal to withstand the explosive transients associated with the firing sequence. The barrel 14 is generally cylindrical to match the shape of the projectile 12 and includes a breech end 18 opposed to a muzzle end 20. The breach end 18 generally receives a cartridge 22 containing the projectile 12 for firing, and upon firing, propellant in the cartridge 22 ignites to generate rapidly expanding combustion gases that propel the projectile 12 through the barrel 14 and out of the muzzle end 20.

The receiver 16 is engaged with the breach end 18 of the barrel 14 and defines a chamber 24 inside the receiver 16. The receiver 16 may be engaged with the breach end 18 of the barrel 14 by threads, press fit, a latch, or other suitable mechanical connection known to one of ordinary skill in the art. The receiver 16 may be any shape that provides a desired external appearance and accommodates the various components involved in the firing sequence of the firearm 10. In particular embodiments, for example, the receiver 16 may be forged or cast as a cylinder to reduce the manufacturing costs. However, the particular shape of the receiver 16 is not a limitation of the present invention unless recited in the claims.

Figure 6:
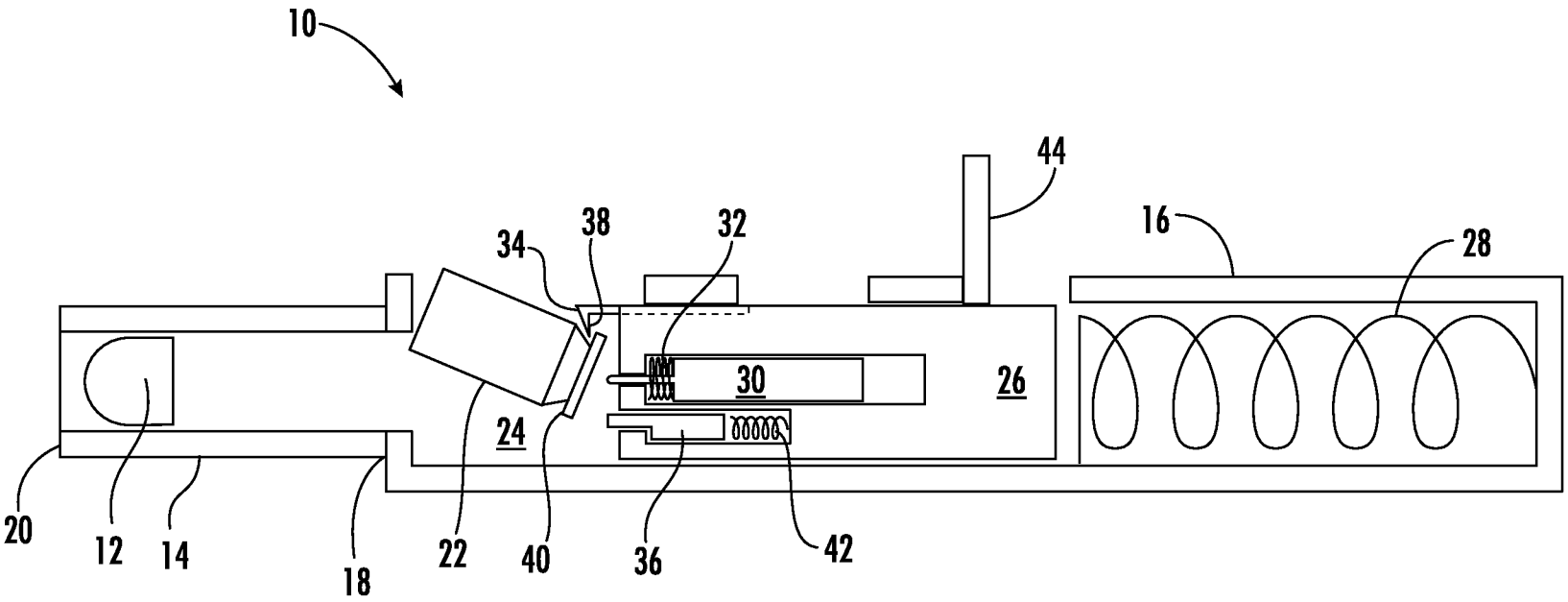
FIG. 6 is a top cross-section of the firearm shown in FIG. 1 recoiling.

A slide or bolt 26 is slidingly engaged with the receiver 16 inside the chamber 24 to alternately position the cartridge 22 in the chamber 24 for firing (FIGS. 3 and 4) or eject the cartridge 22 from the chamber 24 after firing (FIGS. 5 and 6). A charge spring 28 inside the receiver 16 may be engaged with the bolt 26 under compression to bias the bolt 26 axially toward the breach end 18 of the barrel 14. A firing pin 30 may be integrated at least partially inside the bolt 26, and a firing pin spring 32 may be engaged with the firing pin 30 under compression to bias the firing pin 30 axially away from the breach end 18 of the barrel 14. An extractor 34 and an ejector 36 may also be integrated into the bolt 26 to move with the bolt 26. For example, the extractor 34 may extend axially forward from the bolt 26 and include a flange 38 configured to engage with a rim 40 of the cartridge 22, as shown in FIG. 6. An ejector spring 42 may be engaged with the ejector 36 under compression to bias the ejector 36 axially toward the breach end 18 of the barrel 14. As shown in FIGS. 2, 4, and 6, the bolt 26 may further include a cocking handle 44 that extends through the receiver 16 to allow manual cycling of the bolt 26 inside the chamber 24.

A latch 46 is connected to the receiver 16 to alternately engage with or disengage from the bolt 26 during the firing sequence. In the particular embodiment shown in FIG. 1, for example, the latch 46 may include a projection 48 configured to releasably engage with a detent 50 in the bolt 26 during the firing sequence. The latch 46 may be pivotally connected to the receiver 16, and a torsion or spiral spring 52 may be engaged with the latch 46 under compression to bias the latch 46 toward the receiver 16, chamber 24, and/or bolt 26. In this manner, the latch 46 and bolt 26 have a locked position and a released position. In the locked position, shown in FIG. 3, the projection 48 of the latch 46 engages with the detent 50 of the bolt 26 to prevent the bolt 26 from moving away from the breach end 18 of the barrel 14. In the released position, shown in FIGS. 1 and 5, the projection 48 of the latch 46 is not engaged with the detent 50 of the bolt 26, allowing the bolt 26 to move away from the breach end 18 of the barrel 12.

Referring to FIG. 1, the barrel 14 of the firearm 10 includes a vent path 54 through the barrel 14 that is upstream from the muzzle end 20 and downstream from the breech end 18. The vent path 54 provides a fluid pathway for combustion gases to flow out of the barrel 14 to an actuator 56 in sliding engagement with the barrel 14. The actuator 56 may be a rod, lever, tappet, or similar device operably engaged with the vent path 54 at one end and the latch 46 at the other end. In the particular embodiment shown in FIG. 1, for example, the actuator 56 may include a cup 58 at one end operably engaged with the vent path 54 and a sloped surface 60 at the other end in cammed engagement with a complementary surface 62 on the latch 46. The actuator 56 may pass through a pair of supports 64 that allow the actuator 56 to slide axially with respect to the barrel 14 and latch 46 during the firing sequence, and an actuator spring 66 may be engaged with the actuator 56 under compression to bias the actuator 56 toward the vent path 54 and/or muzzle end 20 of the barrel 14. In this arrangement, combustion gases flowing through the vent path 54 may apply force to the cup 58 of the actuator 56 to overcome the bias of the actuator spring 66 and move the actuator 56 toward the latch 46, as shown in FIG. 5. As the actuator 56 moves toward the latch 46, the actuator 56 repositions the latch 46 from the locked position to the released position. For example, the sloped surface 60 on the actuator 56 may slide against the complementary surface 62 on the latch 46 to overcome the bias of the spiral spring 52 and move the projection 48 of the latch 46 away from the receiver 16, chamber 24, and/or bolt 26.

The firearm 10 further includes a trigger 68 that initiates the firing sequence. The trigger 68 may be a button, lever, switch, or other operator suitable for convenient, reliable, and safe operation. For example, in the embodiment shown in FIGS. 1, 3, and 5, the trigger 68 pivotally connects to the receiver 16 or other part of the firearm 10 to releasably engage with a detent 70 in the bolt 26 when the bolt 26 and latch 46 are in the released position, as shown in FIG. 1. A trigger spring 72 may be engaged with the trigger 68 under compression to bias the trigger 68 toward engagement with the detent 70 in the bolt 26.

Operation of the firearm 10 during the firing sequence will now be described with respect to FIGS. 1-6. FIGS. 1 and 2 show the firearm 10 in the cocked position with a detachable magazine 74 engaged with the receiver 16 holding the next cartridge 22 to be loaded. The bolt 26 and latch 46 are released from one another, and the bolt 26 has been moved axially away from the breach end 18 of the barrel 14, compressing the charge spring 28. When the detent 70 in the bolt 26 aligned with the trigger 68, the trigger spring 72 biased the trigger 68 into engagement with the detent 70 to hold the bolt 26 in the cocked position. In the cocked position, the firing pin spring 32 biases the firing pin 30 axially away from the breach end 18 of the barrel 14 so that the firing pin 30 is completely inside the bolt 26. In addition, the ejector spring 42 biases the ejector 36 axially toward the breach end 18 of the barrel 14 so that a portion of the ejector 36 extends outside of the bolt 26. Lastly, the actuator spring 66 biases the actuator 56 toward the vent path 54 and/or muzzle end 20 of the barrel 14 so that the sloped surface 60 on the actuator 56 allows the spiral spring 52 to bias the projection 48 of the latch 46 toward the receiver 16, chamber 24, and/or bolt 26.

To fire the firearm 10, pressure is applied to the trigger 68 to overcome the bias of the trigger spring 72 and disengage the trigger 68 from the detent 70 in the bolt 26. Once the trigger 68 disengages from the detent 70 in the bolt 26, the compressed charge spring 28 rapidly pushes the bolt 26 axially inside the chamber 24 toward the breach end 18 of the barrel 14. As the bolt 26 slides toward the breach end 18, the front of the bolt 26 contacts the rim 40 of the top-most cartridge 22 in the magazine 74 to strip this cartridge 22 from the magazine 74. As the bolt 26 and cartridge 22 continue moving forward, the bolt 26 pushes the cartridge 22 into the breach end 18 until the rim 40 of the cartridge 22 reaches the breach end 18, preventing further forward movement of the cartridge 22 and bolt 26.

FIGS. 3 and 4 show the firearm 10 after firing when the rim 40 of the cartridge 22 reaches the breach end 18. As shown in FIGS. 3 and 4, the bolt 26 is pressed against the rim 40 to fully seat the cartridge 22 in the breach end 18 of the barrel 14. The latch 46 and bolt 26 are in the locked position, with the projection 48 of the latch 46 engaged with the detent 50 of the bolt 26 to prevent the bolt 26 from moving away from the breach end 18 of the barrel 14. In addition, the rim 40 of the cartridge 22 is pressed against the ejector 36 to further compress the ejector spring 42 and force the ejector 36 completely inside the bolt 26.

When the rim 40 and bolt 26 reached the breach end 18 of the barrel 14, the sudden deceleration of the bolt 26 caused inertia in the firing pin 30 to overcome the firing pin spring 32 bias. As a result, the firing pin 30 continued to move axially toward the breach end 18 until striking the cartridge 22 and igniting the propellant in the cartridge 22. Ignition of the propellant generates the combustion gases. The bolt 26 and the latch 46 are in the locked position, preventing the bolt 26 from moving away from the breach end 18 of the barrel 14. As a result, the full force of the rapidly expanding combustion gases propels the projectile 12 through the barrel 14 and out the muzzle end 20.

As the projectile 12 passes the vent path 54, a portion of the combustion gases flow through the vent path 54 to recoil the firearm 10, as shown in FIGS. 5 and 6. The combustion gases flowing through the vent path 54 apply force to the cup 58 of the actuator 56 to overcome the bias of the actuator spring 66 and move the actuator 56 axially toward the latch 46. As the actuator 56 moves toward the latch 46, the actuator 56 repositions the latch 46 from the locked position to the released position. Specifically, the sloped surface 60 on the actuator 56 slides against the complementary surface 62 on the latch 46 to overcome the bias of the spiral spring 52 and move the projection 48 of the latch 46 away from the receiver 16, chamber 24, and/or bolt 26. When the projection 48 of the latch 46 disengages from the detent 50 in the bolt 26, the latch 46 releases the bolt 26, allowing the bolt 26 to move away from the breach end 18 of the barrel 14. With the latch 46 and bolt 26 in the released position, the force of the expanding combustion gases inside the barrel 14 overcomes the force of the charge spring 28 to move the bolt 26 and expended cartridge 22 away from the breach end 18 of the barrel 14.

As the bolt 26 moves away from the breach end 18, the flange 38 of the extractor 34 engages with one side of the rim 40 of the cartridge 22 to pull or extract the cartridge 22 from the breach end 18 of the barrel 14. Simultaneously, the ejector spring 42 biases the ejector 36 out of the bolt 26 to push against an opposite side of the rim 40 to flip or eject the spent cartridge 22 out of the receiver 16. The bolt 26 continues to move away from the breach end 18 until the detent 70 in the bolt 26 aligns with the trigger 68, allowing the trigger spring 72 to bias the trigger 68 into engagement with the detent 70 to hold the bolt 26 in the cocked position, as shown in FIG. 1. In the cocked position, the firing pin spring 32 again biases the firing pin 30 axially away from the breach end 18 of the barrel 14 so that the firing pin 30 is completely inside the bolt 26. In addition, the ejector spring 42 biases the ejector 36 axially toward the breach end 18 of the barrel 14 so that a portion of the ejector 36 extends outside of the bolt 26. Lastly, the actuator spring 66 biases the actuator 56 toward the vent path 54 and/or muzzle end 20 of the barrel 14 so that the sloped surface 60 on the actuator 56 allows the spiral spring 52 to bias the projection 48 of the latch 46 toward the receiver 16, chamber 24, and/or bolt 26.

Figure 7:
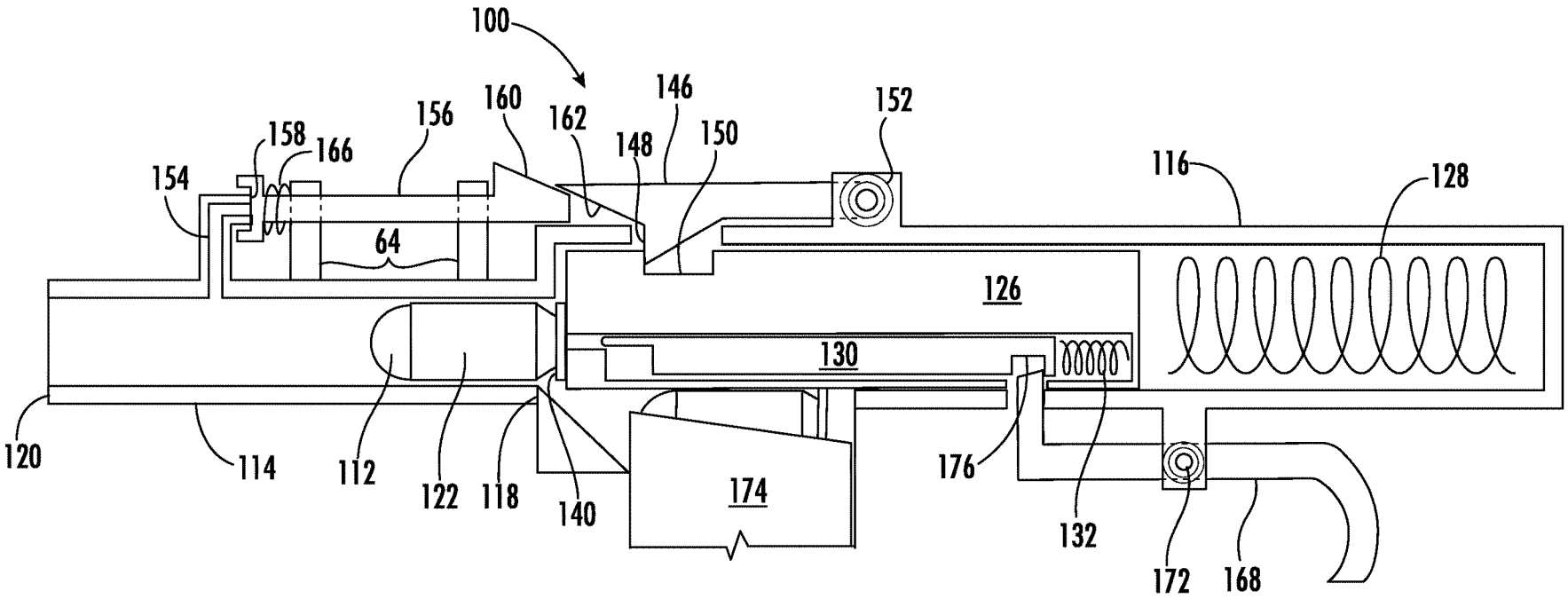
FIG. 7 is a side cross-section view of a firearm according to an alternate embodiment of the present invention in a cocked position.
Figure 8:
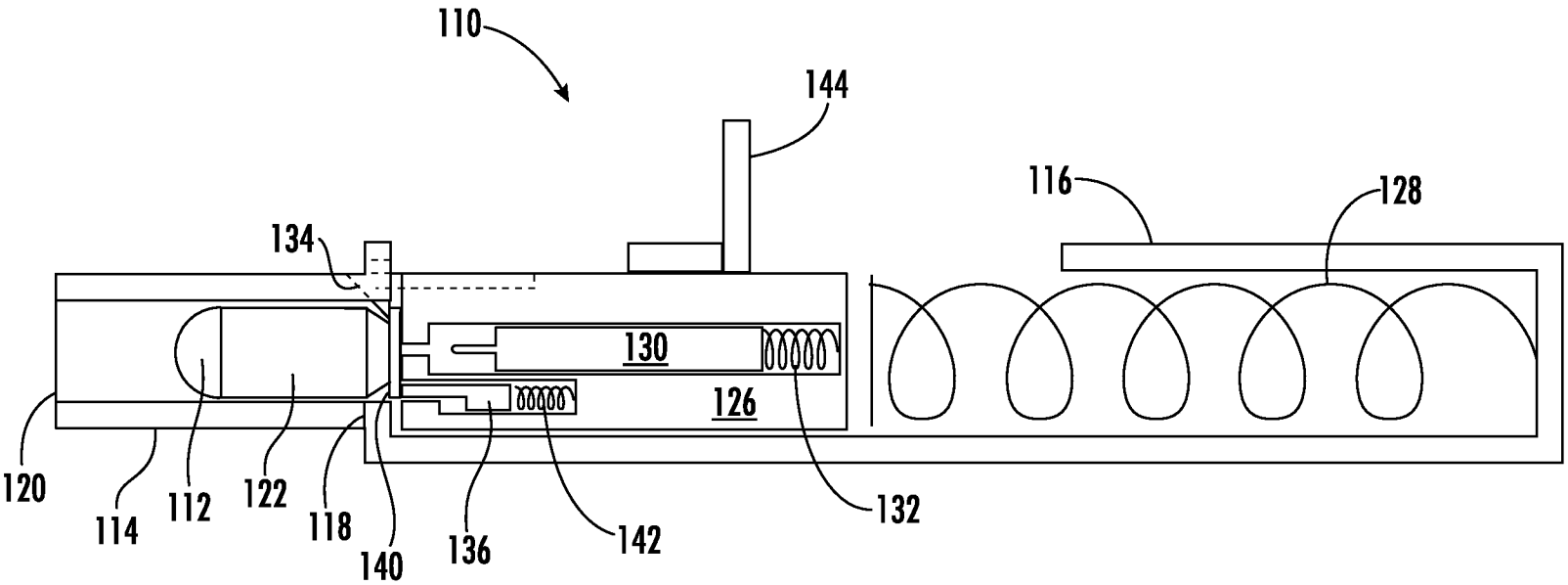
FIG. 8 is a top cross-section view of the firearm shown in FIG. 7 in the cocked position.
Figure 9:
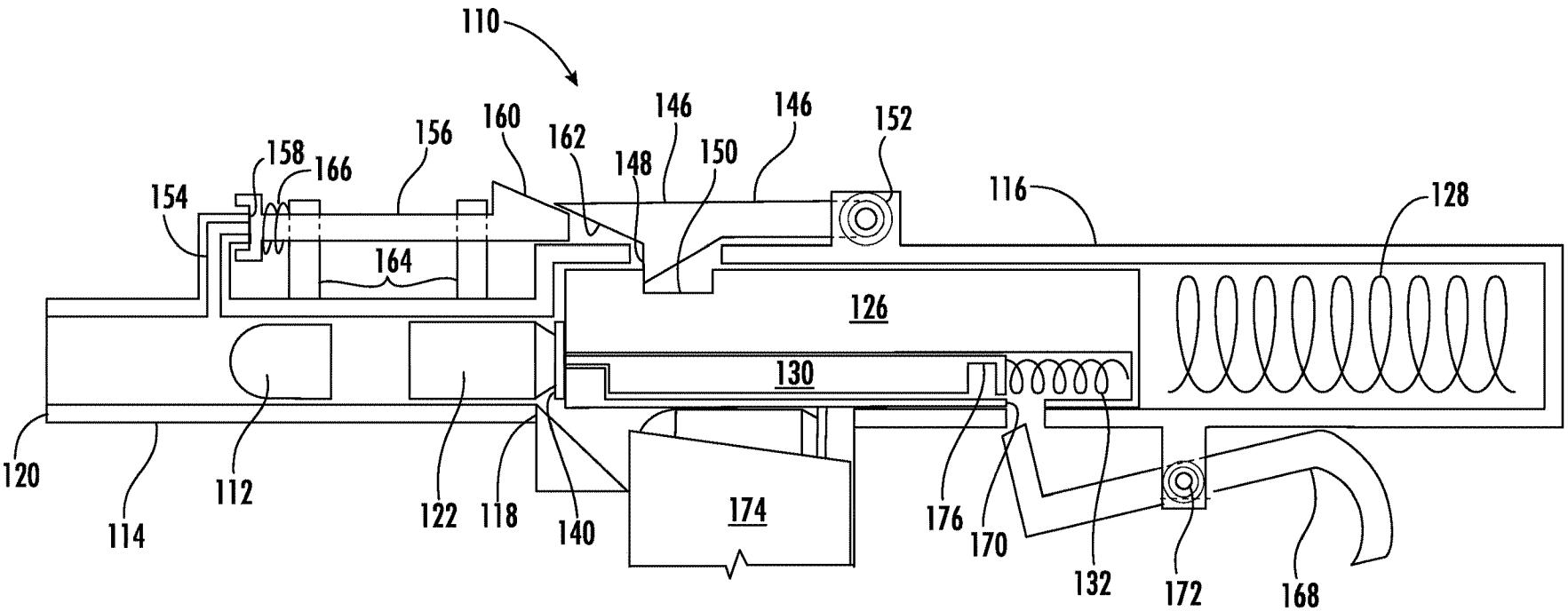
FIG. 9 is a side cross-section view of the firearm shown in FIG. 7 after firing.
Figure 10:
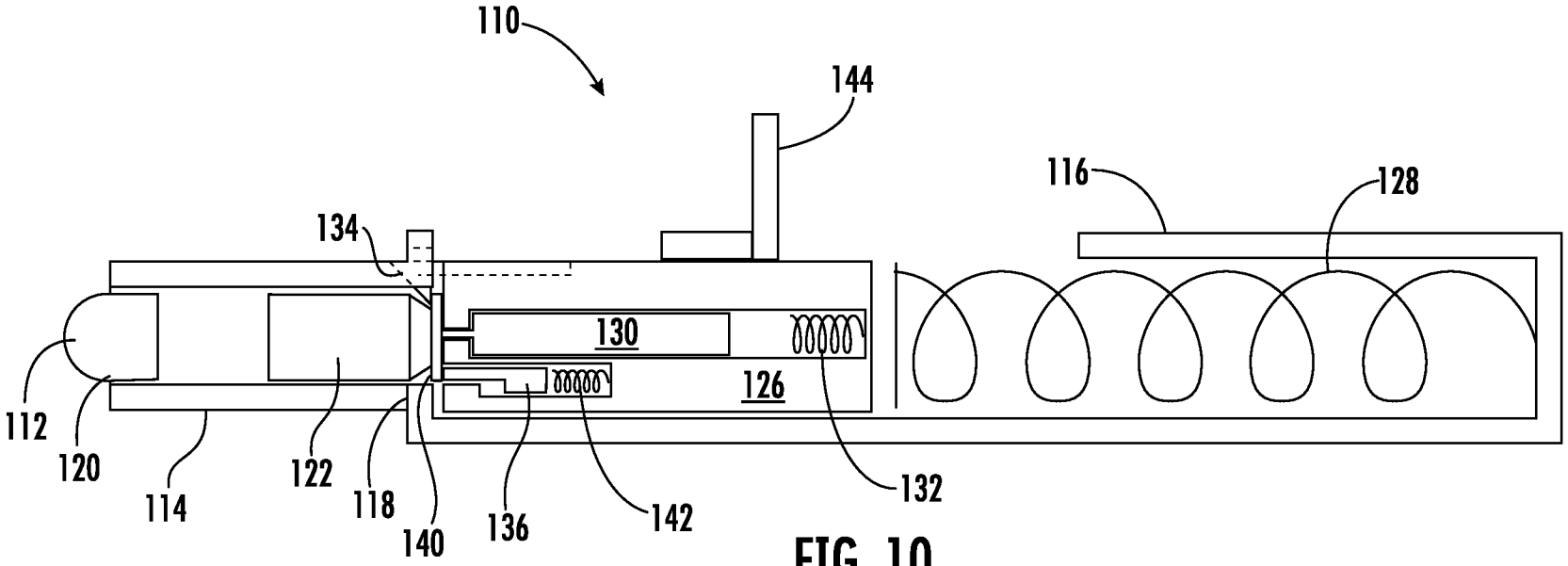
FIG. 10 is a top cross-section of the firearm shown in FIG. 7 after firing.
Figure 11:
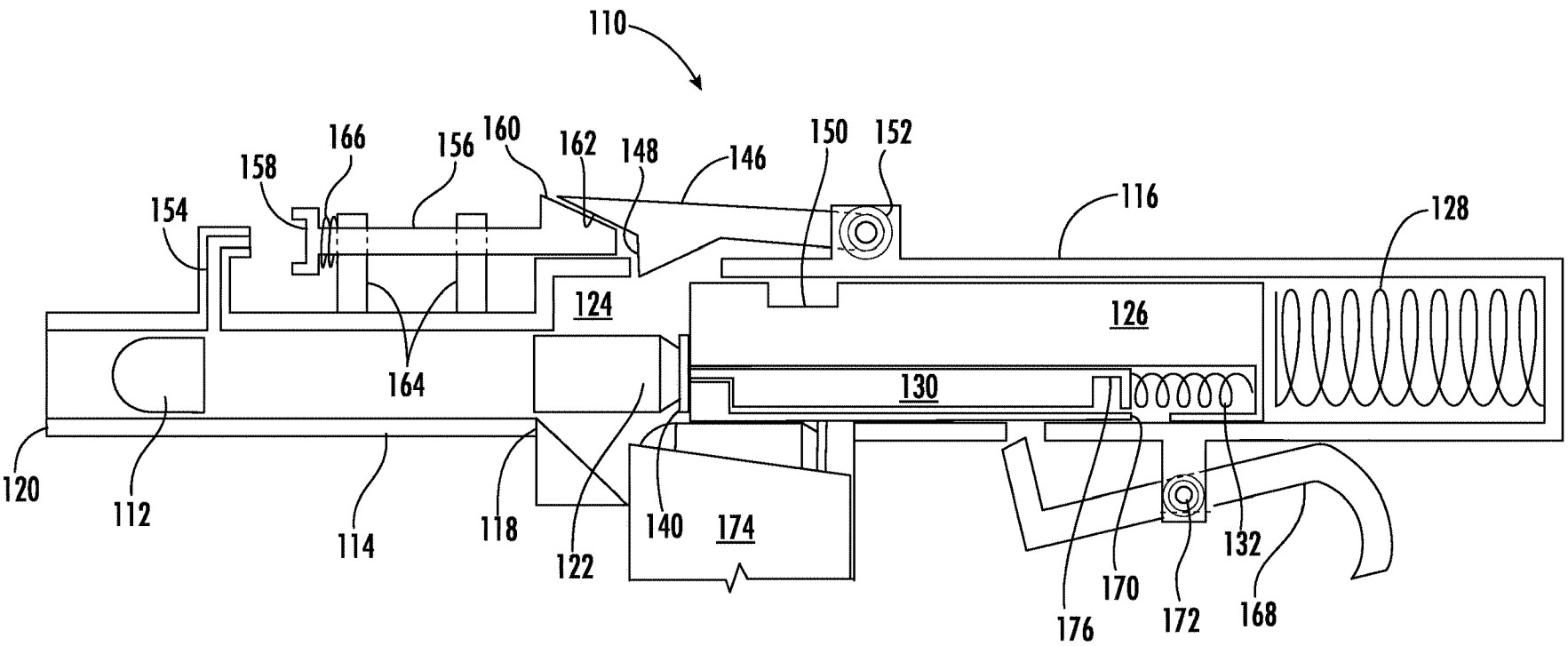
FIG. 11 is a side cross-section view of the firearm shown in FIG. 7 recoiling.
Figure 12:
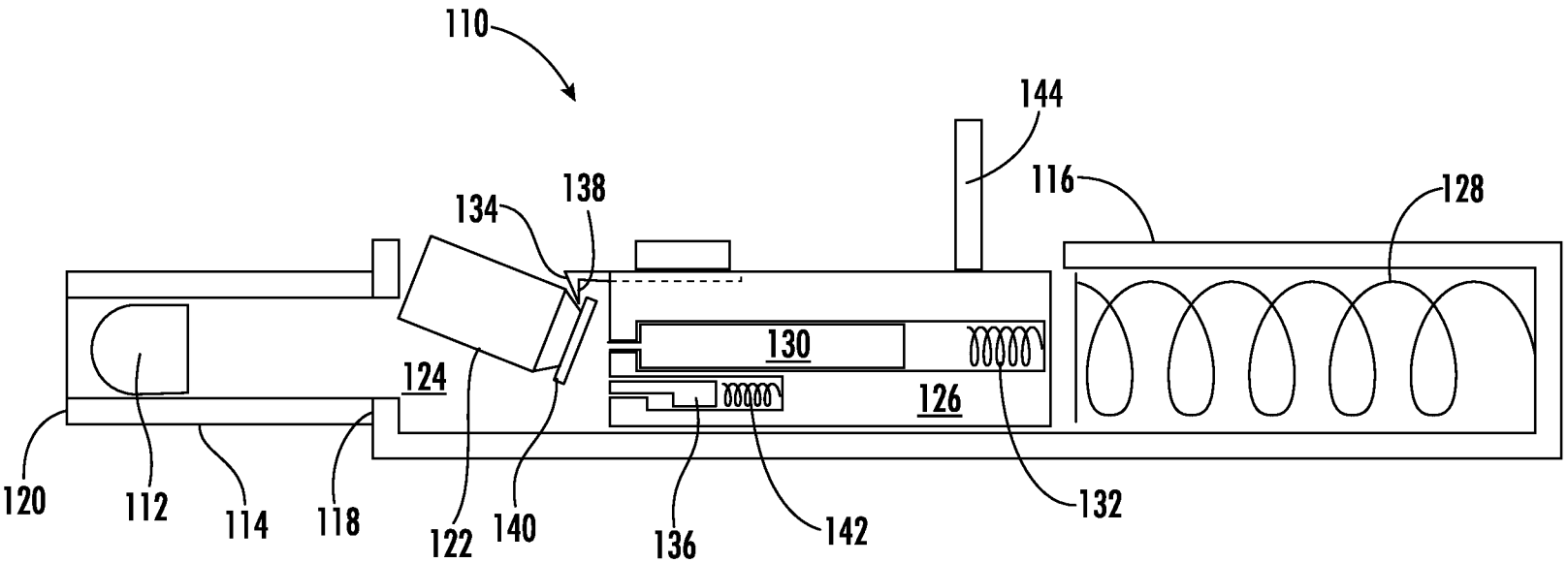
FIG. 12 is a top cross-section of the firearm shown in FIG. 7 recoiling.

FIGS. 7-12 provide side and top cross-section views of a firearm 100 according to an alternate embodiment of the present invention. FIGS. 7 and 8 provide side and top cross-section views, respectively, of the firearm 100 in the cocked position. FIGS. 9 and 10 provide side and top cross-section views, respectively, of the firearm 100 after firing. FIGS. 11 and 12 provide side and top cross-section views, respectively, of the firearm 100 recoiling.

As shown in FIGS. 7-12, the firearm 100 includes a barrel 114 and a receiver 116, as is generally known in the art. The barrel 114 and the receiver 116 may be forged or cast from steel or other sufficiently strong metal to withstand the explosive transients associated with the firing sequence. The barrel 114 is generally cylindrical to match the shape of the projectile 112 and includes a breech end 118 opposed to a muzzle end 120. The breach end 118 generally receives a cartridge 122 containing a projectile 112 for firing, and upon firing, propellant in the cartridge 122 ignites to generate rapidly expanding combustion gases that propel the projectile 112 through the barrel 114 and out of the muzzle end 120.

The receiver 116 is engaged with the breach end 118 of the barrel 114 and defines a chamber 124 inside the receiver 116. The receiver 116 may be engaged with the breach end 118 of the barrel 114 by threads, press fit, a latch, or other suitable mechanical connection known to one of ordinary skill in the art. The receiver 116 may be any shape that provides a desired external appearance and accommodates the various components involved in the firing sequence of the firearm 100. In particular embodiments, for example, the receiver 116 may be forged or cast as a cylinder to reduce the manufacturing costs. However, the particular shape of the receiver 116 is not a limitation of the present invention unless recited in the claims.

A slide or bolt 126 is slidingly engaged with the receiver 116 inside the chamber 124 to alternately position the cartridge 122 in the chamber 124 for firing (FIGS. 9 and 10) or eject the cartridge 122 from the chamber 124 after firing (FIGS. 11 and 12). A charge spring 128 inside the receiver 116 may be engaged with the bolt 126 under compression to bias the bolt 126 axially toward the breach end 118 of the barrel 114. A firing pin 130 may be integrated at least partially inside the bolt 126, and a firing pin spring 132 may be engaged with the firing pin 130 under compression to bias the firing pin 130 axially toward the breach end 118 of the barrel 114. An extractor 134 and an ejector 136 may also be integrated into the bolt 126 to move with the bolt 126. For example, the extractor 134 may extend axially forward from the bolt 126 and include a flange 138 configured to engage with a rim 140 of the cartridge 122, as shown in FIG. 12. An ejector spring 142 may be engaged with the ejector 136 under compression to bias the ejector 136 axially toward the breach end 118 of the barrel 114. As shown in FIGS. 8, 10, and 12, the bolt 126 and/or firing pin 130 may further include a cocking handle 144 that extends through the receiver 116 to allow manual cycling of the bolt 126 and/or firing pin 130 inside the chamber 124.

A latch 146 is connected to the receiver 116 to alternately engage with or disengage from the bolt 126 during the firing sequence. In the particular embodiment shown in FIG. 7, for example, the latch 146 may include a projection 148 configured to releasably engage with a detent 150 in the bolt 126 during the firing sequence. The latch 146 may be pivotally connected to the receiver 116, and a torsion or spiral spring 152 may be engaged with the latch 146 under compression to bias the latch 146 toward the receiver 116, chamber 124, and/or bolt 126. In this manner, the latch 146 and bolt 126 have a locked position and a released position. In the locked position, shown in FIGS. 7 and 9, the projection 148 of the latch 146 engages with the detent 150 of the bolt 126 to prevent the bolt 126 from moving away from the breach end 118 of the barrel 114. In the released position, shown in FIG. 11, the projection 148 of the latch 146 is not engaged with the detent 150 of the bolt 126, allowing the bolt 126 to move away from the breach end 118 of the barrel 112.

Referring to FIG. 7, the barrel 114 of the firearm 100 includes a vent path 154 through the barrel 114 that is upstream from the muzzle end 120 and downstream from the breech end 118. The vent path 154 provides a fluid pathway for combustion gases to flow out of the barrel 114 to an actuator 156 in sliding engagement with the barrel 114. The actuator 156 may be a rod, lever, tappet, or similar device operably engaged with the vent path 154 at one end and the latch 146 at the other end. In the particular embodiment shown in FIG. 7, for example, the actuator 156 may include a cup 158 at one end operably engaged with the vent path 154 and a sloped surface 160 at the other end in cammed engagement with a complementary surface 162 on the latch 146. The actuator 156 may pass through a pair of supports 164 that allow the actuator 156 to slide axially with respect to the barrel 114 and latch 146 during the firing sequence, and an actuator spring 166 may be engaged with the actuator 156 under compression to bias the actuator 156 toward the vent path 154 and/or muzzle end 120 of the barrel 114. In this arrangement, combustion gases flowing through the vent path 154 may apply force to the cup 158 of the actuator 156 to overcome the bias of the actuator spring 166 and move the actuator 156 toward the latch 146, as shown in FIG. 11. As the actuator 156 moves toward the latch 146, the actuator 156 repositions the latch 146 from the locked position to the released position. For example, the sloped surface 160 on the actuator 156 may slide against the complementary surface 162 on the latch 146 to overcome the bias of the spiral spring 152 and move the projection 148 of the latch 146 away from the receiver 116, chamber 124, and/or bolt 126.

The firearm 100 further includes a trigger 168 that initiates the firing sequence. The trigger 168 may be a button, lever, switch, or other operator suitable for convenient, reliable, and safe operation. For example, in the embodiment shown in FIGS. 7, 9, and 11, the trigger 168 pivotally connects to the receiver 116 or other part of the firearm 100 to releasably engage with a detent 176 in the firing pin 130 when the bolt 126 and latch 146 are in the locked position, as shown in FIGS. 7 and 9. A trigger spring 172 may be engaged with the trigger 168 under compression to bias the trigger 168 toward engagement with the detent 176 in the firing pin 130.

Operation of the firearm 100 during the firing sequence will now be described with respect to FIGS. 7-12. FIGS. 7 and 8 show the firearm 100 in the cocked position with a detachable magazine 174 engaged with the receiver 116 holding the next cartridge 122 to be loaded. As shown in FIGS. 7 and 8, the bolt 126 is pressed against the rim 140 to fully seat the cartridge 122 in the breach end 118 of the barrel 114. The actuator spring 166 biases the actuator 156 toward the vent path 154 and/or muzzle end 120 of the barrel 114 so that the sloped surface 160 on the actuator 156 allows the spiral spring 152 to bias the projection 148 of the latch 146 toward the receiver 116, chamber 124, and/or bolt 126. As a result, the latch 146 and bolt 126 are in the locked position, with the projection 148 of the latch 146 engaged with the detent 150 of the bolt 126 to prevent the bolt 126 from moving away from the breach end 118 of the barrel 114. In addition, the rim 140 of the cartridge 122 is pressed against the ejector 136 to further compress the ejector spring 142 and force the ejector 136 completely inside the bolt 126. Lastly, the detent 176 of the firing pin 130 is aligned with the trigger 168, and the trigger spring 172 biases the trigger 168 into engagement with the detent 176 to hold the firing pin 130 in the cocked position. In the cocked position, the firing pin 130 is completely inside the bolt 126, and the firing pin spring 132 biases the firing pin 130 axially toward the breach end 118 of the barrel 114.

To fire the firearm 100, pressure is applied to the trigger 168 to overcome the bias of the trigger spring 172 and disengage the trigger 168 from the detent 176 in the firing pin 130, as shown in FIGS. 9 and 10. Once the trigger 168 disengages from the detent 176 in the firing pin 130, the compressed firing pin spring 132 rapidly pushes the firing pin 130 axially toward the breach end 118 of the barrel 114, striking the cartridge 122 and igniting the propellant in the cartridge 122. Ignition of the propellant generates the combustion gases. The bolt 126 and the latch 146 are in the locked position, preventing the bolt 126 from moving away from the breach end 118 of the barrel 114. As a result, the full force of the rapidly expanding combustion gases propels the projectile 112 through the barrel 114 and out the muzzle end 120.

As the projectile 112 passes the vent path 154, a portion of the combustion gases flow through the vent path 154 to recoil the firearm 100, as shown in FIGS. 11 and 12. The combustion gases flowing through the vent path 154 apply force to the cup 158 of the actuator 156 to overcome the bias of the actuator spring 166 and move the actuator 156 axially toward the latch 146. As the actuator 156 moves toward the latch 146, the actuator 156 repositions the latch 146 from the locked position to the released position. Specifically, the sloped surface 160 on the actuator 156 slides against the complementary surface 162 on the latch 146 to overcome the bias of the spiral spring 152 and move the projection 148 of the latch 146 away from the receiver 116, chamber 124, and/or bolt 126. When the projection 148 of the latch 146 disengages from the detent 150 in the bolt 126, the latch 146 releases the bolt 126, allowing the bolt 126 to move away from the breach end 118 of the barrel 114. With the latch 146 and bolt 126 in the released position, the force of the expanding combustion gases inside the barrel 114 overcomes the force of the charge spring 128 to move the bolt 126 and expended cartridge 122 away from the breach end 118 of the barrel 114.

As the bolt 126 moves away from the breach end 118, the flange 138 of the extractor 134 engages with one side of the rim 140 of the cartridge 122 to pull or extract the cartridge 122 from the breach end 118 of the barrel 114. Simultaneously, the ejector spring 142 biases the ejector 136 out of the bolt 126 to push against an opposite side of the rim 140 to flip or eject the spent cartridge 122 out of the receiver 116. The bolt 126 continues to move away from the breach end 118, compressing the charge spring 128, until the force provided by the charge spring 128 exceeds the force provided by the combustion gases. At that point, the charge spring 128 moves the bolt 126 axially back towards the breach end 118 of the barrel 14.

As the bolt 126 slides toward the breach end 118, the front of the bolt 126 contacts the rim 140 of the top-most cartridge 122 in the magazine 174 to strip this cartridge 122 from the magazine 174. As the bolt 126 and cartridge 122 continue moving forward, the bolt 126 pushes the cartridge 122 into the breach end 118 until the rim 140 of the cartridge 122 reaches the breach end 118, preventing further forward movement of the cartridge 122 and bolt 126. When the detent 176 in the firing pin 130 aligns with the trigger 168, the trigger spring 172 biases the trigger 168 into engagement with the detent 176 to hold the firing pin 130 in the cocked position, as shown in FIG. 7.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A firearm, comprising:

a barrel;

a breech end of said barrel;

a vent path through said barrel downstream from said breech end;

a receiver engaged with said breach end of said barrel, wherein said receiver defines a chamber;

a latch connected to said receiver;

an actuator downstream from said vent path, wherein said actuator is in direct cammed engagement with said latch; and a bolt at least partially inside said chamber, wherein said bolt has a locked position in which said latch is engaged with said bolt to prevent said bolt from moving away from said breech end of said barrel and a released position in which said latch is not engaged with said bolt.

2. The firearm as in claim 1, wherein said actuator is slidingly engaged with said barrel.

3. The firearm as in claim 1, wherein said bolt is biased toward said breech end of said barrel.

4. The firearm as in claim 1, further comprising a trigger engaged with said bolt when said bolt is in said released position.

5. The firearm as in claim 1, further comprising a firing pin at least partially inside said bolt.

6. The firearm as in claim 5, further comprising a trigger engaged with said firing pin when said bolt is in said locked position.

7. A firearm comprising:

a barrel;

a breech end of said barrel;

a receiver engaged with said breach end of said barrel, wherein said receiver defines a chamber;

a bolt at least partially inside said chamber;

a latch connected to said receiver, wherein said latch has a locked position in which said latch is engaged with said bolt to prevent said bolt from moving away from said breech end of said barrel and a released position in which said latch is not engaged with said bolt;

a vent path through said barrel downstream from said breech end; and an actuator downstream from said vent path, wherein said actuator has a sloped surface in direct cammed engagement with a complementary surface on said latch and said actuator is configured to reposition said latch from said locked position to said released position.

8. The firearm as in claim 7, wherein said actuator is slidingly engaged with said barrel.

9. The firearm as in claim 7, wherein said bolt is biased toward said breech end of said barrel.

10. The firearm as in claim 7, further comprising a trigger engaged with said bolt when said latch is in said released position.

11. The firearm as in claim 7, further comprising a firing pin at least partially inside said bolt.

12. The firearm as in claim 11, further comprising a trigger engaged with said firing pin when said latch is in said locked position.

13. A firearm comprising:

a barrel;

a muzzle end of said barrel;

a breech end of said barrel upstream from said muzzle end;

a receiver engaged with said breach end of said barrel;

a latch pivotally connected to said receiver;

a bolt slidingly engaged with said receiver;

a vent path through said barrel upstream from said muzzle end and downstream from said breech end;

an actuator downstream from said vent path, wherein said actuator has a sloped surface in direct cammed engagement with a complementary surface on said latch; and wherein said latch has a locked position in which said latch is engaged with said bolt to prevent said bolt from moving away from said breech end of said barrel and a released position in which said latch is not engaged with said bolt.

14. The firearm as in claim 13, wherein said actuator is slidingly engaged with said barrel and biased toward said muzzle end of said barrel.

15. The firearm as in claim 13, further comprising a trigger engaged with said bolt when said latch is in said released position.

16. The firearm as in claim 13, further comprising a firing pin at least partially inside said bolt.

17. The firearm as in claim 16, further comprising a trigger engaged with said firing pin when said latch is in said locked position.

* * * * *